US008982549B2

(12) United States Patent
Yang

(10) Patent No.: US 8,982,549 B2
(45) Date of Patent: Mar. 17, 2015

(54) FLASH DRIVE PROTECTION COVER

(75) Inventor: Steven Yang, Changhua (TW)

(73) Assignee: Steven Yang

( * ) Notice: Subject to any disclaimer, the term of this patent is extended or adjusted under 35 U.S.C. 154(b) by 501 days.

(21) Appl. No.: 13/453,813

(22) Filed: Apr. 23, 2012

(65) Prior Publication Data

US 2012/0300385 A1 Nov. 29, 2012

(30) Foreign Application Priority Data

May 24, 2011 (CN) ..... 2011 2 0168699 U

(51) Int. Cl.

| | |
|---|---|
| ***H05K 5/00*** | (2006.01) |
| ***H05K 7/00*** | (2006.01) |
| ***A47G 29/00*** | (2006.01) |
| ***F16M 11/38*** | (2006.01) |
| ***E05C 5/02*** | (2006.01) |
| ***A45F 5/00*** | (2006.01) |
| *A45C 13/00* | (2006.01) |
| *A45C 11/00* | (2006.01) |
| *A45F 3/00* | (2006.01) |

(52) U.S. Cl.

CPC . *A45F 5/00* (2013.01); *A45C 13/00* (2013.01); *A45C 2011/002* (2013.01); *A45F 2003/003* (2013.01); *A45F 2005/006* (2013.01); *A45F 2200/05* (2013.01); *A45F 2200/0516* (2013.01)

USPC ..... 361/679.32; 361/679.02; 361/679.18; 361/679.19; 361/679.26; 248/84; 248/171; 292/59; 292/60; 292/341.11

(58) Field of Classification Search

USPC ..... 361/679.01–679.09, 679.1–679.19, 361/679.21–679.29, 679.31–679.45, 361/679.55–679.6, 724–747; 348/14.07, 348/51–52, 177, 333.01–333.13, 739; 248/917–924, 80–88, 155.1–155.5, 248/166–173, 180.1–186.2, 229.1–231.51, 248/271.4, 292.14, 316.1–316.8; 292/1–62, 292/113, 169.11–169.23, 341.11–341.19; 312/223.1, 223.2, 331; 369/75.1, 75.2, 369/75.11, 75.21, 76, 77.11, 77.21, 78, 79, 369/80, 81, 82; 360/97.01, 98.01, 137, 360/137 D

See application file for complete search history.

(56) References Cited

U.S. PATENT DOCUMENTS

| | | | | |
|---|---|---|---|---|
| 6,456,500 | B1 * | 9/2002 | Chen | 361/752 |
| 2005/0161513 | A1 * | 7/2005 | Huang et al. | 235/492 |
| 2006/0190664 | A1 * | 8/2006 | Chen | 710/313 |

* cited by examiner

*Primary Examiner* — Jerry Wu

(57) ABSTRACT

A flash drive protection structure includes a decoration cover and a protective cover. The decoration cover that is made by elastic materials includes a cover block and a receiving space spacedly. The cover block has a cover hole facing the receiving space, and a connecting post is formed inside the receiving space. The protective cover has a first and a second surface, and the protective cover is disposed in the receiving space of the decoration cover through the first surface, while the second surface is exposed outside the decoration cover. The protective cover has a connecting hole at the first surface to connect the connecting post of the decoration cover. Also, the protective cover has a receiving trough toward the cover block, and one end of the flash drive is plugged into the receiving trough, while the other end is plugged into the cover hole of the cover block.

8 Claims, 9 Drawing Sheets

FLASH DRIVE PROTECTION COVER

FIELD OF THE INVENTION

The present invention relates to a protective structure of a flash drive to achieve the goal of protecting the flash drive, and more particularly to a protective structure with a decoration cover to provide different designs to increase the practicability.

BACKGROUND OF THE INVENTION

As technology continues to progress and develop, various electronic devices such as flash drives, mobile phones, MP3, etc. are constantly being introduced, which not only allows users to fully enjoy the fruits of scientific and technological progress, but also significantly enhances work efficiency. Among the electronic devices, flash drives have the advantages of large capacity, fast transmission speed, portable, low cost, convenience and plug to use. Flash drives are widely used in data transmission, however, because the size of the flash drive is usually small and may be lost when carrying it. Also, when the user carries the flash drive, the connecting portion of the flash drive may suffer from collision or abrasion. Furthermore, when the weather or the temperature of the user changes, the flash drive is easy to be moisturized to cause short circuit and reduce the durability thereof. Moreover, the style or design of the flash drive may affect the desire of people to purchase and carry the flash drive, so the flash drive with monotonous design is less desirable and unattractive, and difficult to increase additional value of the flash drive. When considering the life of the flash drive, if the user is tired of the style or design of the flash drive, the user is not able to change the appearance of the flash drive. Thus, there remains a need for a new and improved cover for the flash drive to overcome the problems above.

SUMMARY OF THE INVENTION

To solve and overcome the problems stated above, the present invention provides a flash drive protection structure including a decoration cover and a protective cover. The decoration cover that is made by elastic materials includes a cover block and a receiving space spacedly. The cover block has a cover hole facing the receiving space, and one end surface of the cover hole forms a guiding surface, and a connecting post is formed inside the receiving space. The protective cover has a first surface and a second surface, and the protective cover is disposed in the receiving space of the decoration cover through the first surface, while the second surface is exposed outside the decoration cover. The protective cover has a connecting hole at the first surface to connect the connecting post of the decoration cover. Also, the protective cover has a receiving trough toward the direction of the cover block, and one end of the flash drive is plugged into the receiving trough, while the other end is plugged into the cover hole of the cover block.

The primary objective of the present invention is that the cover block has the cover hole, and the protective cover has the receiving trough corresponding to the cover hole, so that the flash drive can be placed between the cover block and protective cover through the disposition of the cover block and the protective cover. This design can protect the flash drive when it is not in use to avoid collision or abrasion, and to achieve the goal of waterproof, The second objective of the present invention is that the decoration cover is used to wrap the cover block and the protective cover to provide different designs of the protective cover to increase the value of the flash drive and attract more people to purchase.

Another objective of the present invention is that the decoration cover has the attaching surface, while the step portion is at the outer surface of the protective cover, and since the engaging strength is increased through the attaching surface and the step portion, the protective cover and the decoration cover would have a smooth contact surface.

A further objective of the present invention is that the protective cover is disposed in the receiving space of the decoration cover, and the protective cover partially exposes outside the decoration cover through the second surface, so that the protective cover can be easily detached from the decoration cover to achieve the goal of quick retrieval to increase practicability.

Still a further objective of the present invention is that the cover block forms the guiding surface at the cover hole, and when the guiding surface is bended to separate the cover block and the protective cover, the flash drive can evade through the guiding surface so that the flash drive can be easily taken out.

DETAILED DESCRIPTION OF THE INVENTION

Figure 1:
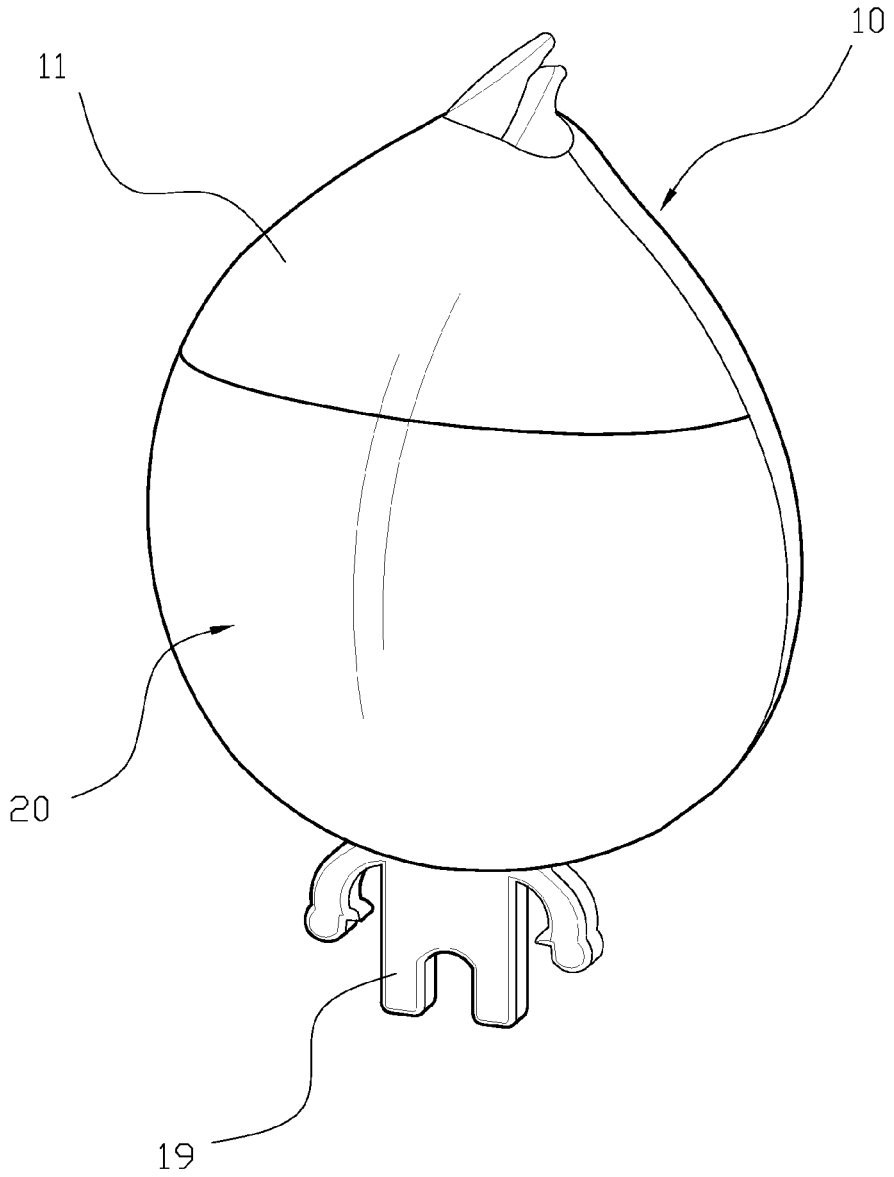
FIG. 1 illustrates a three-dimensional view in the present invention.
Figure 2:
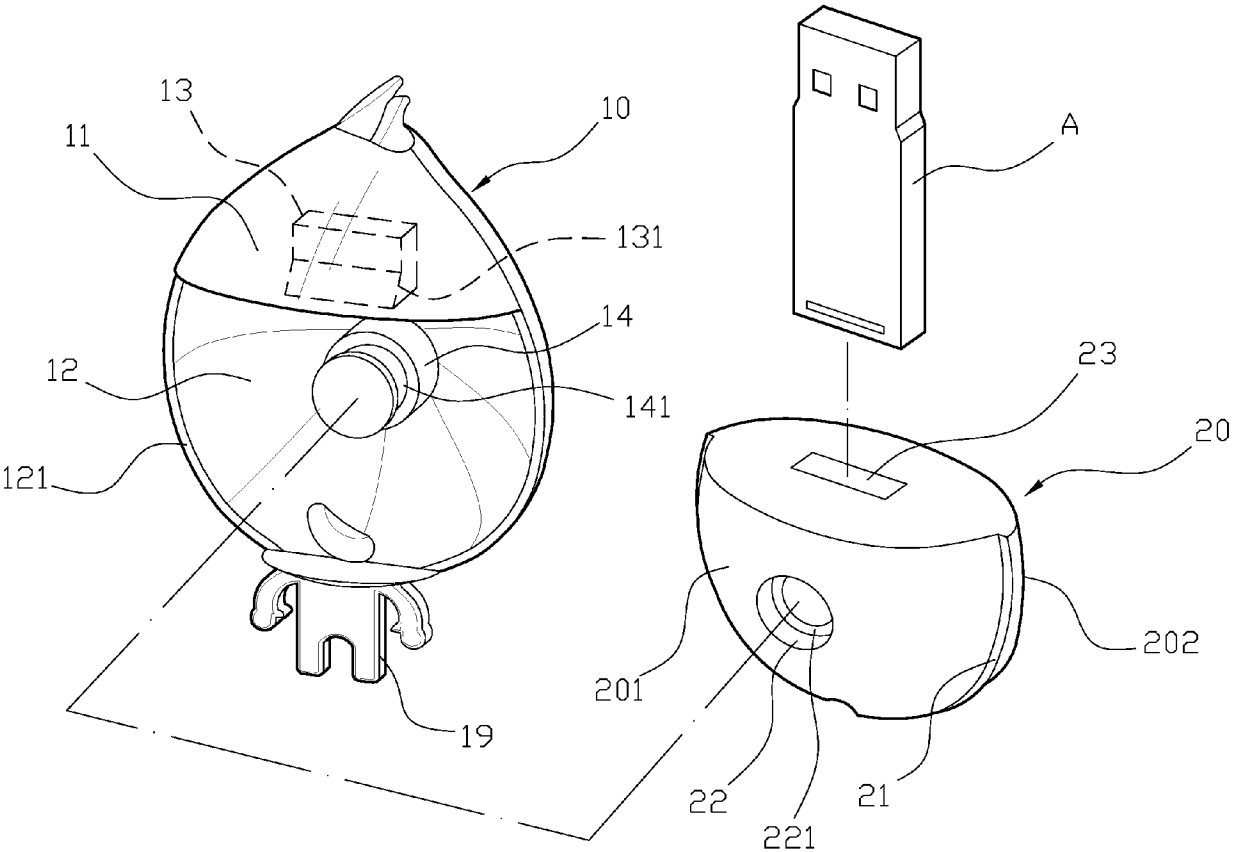
FIG. 2 illustrates a three-dimensional exploded view in the present invention.
Figure 3:
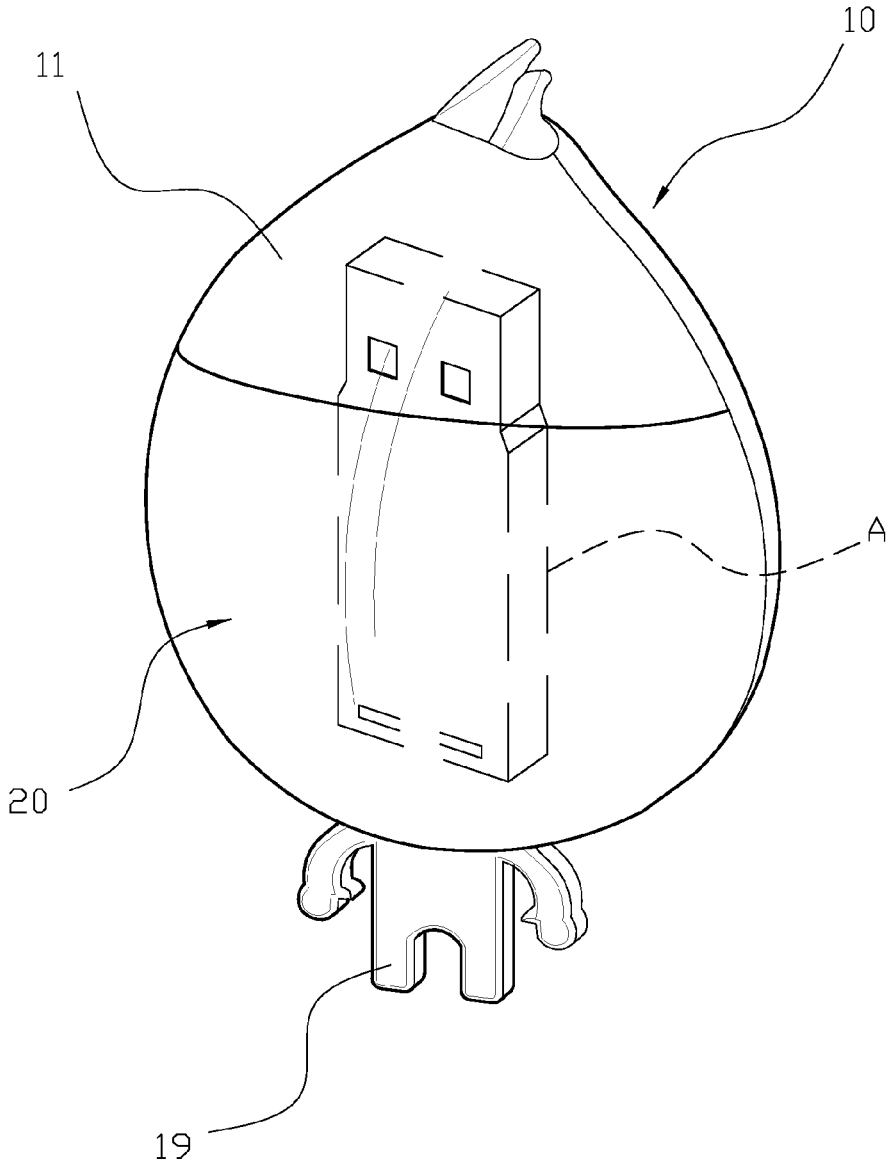
FIG. 3 illustrates another three-dimensional view in the present invention.
Figure 4:
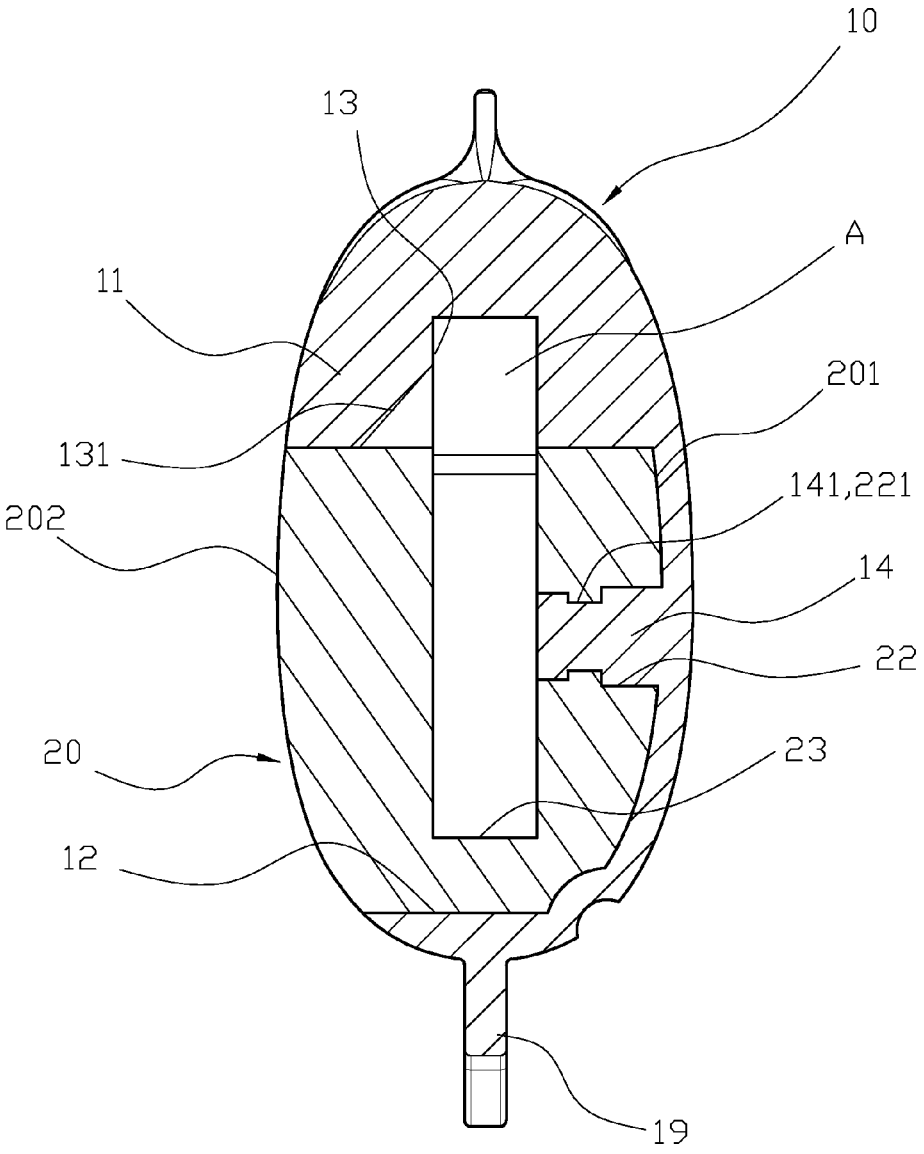
FIG. 4 illustrates a sectional view in the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, a flash drive protection cover includes a decoration cover (10) and a protective cover (20) that is used to protect a flash drive (A), and the decoration cover (10) provides a decorating effect to the protective cover (20). The decoration cover (10) that is made by elastic materials includes a cover block (11) and a receiving space (12) spacedly. The cover block (11) has a cover hole (13) facing the receiving space (12), and a guiding surface (131) is formed at one end of the cover hole (13). The decoration cover (10) is of an arc shape in one end surface of the receiving space (12), and a connecting post (14) is formed inside the receiving space (12). The connecting post (14) has a recessed portion (141), and the decoration cover (10) forms an attaching surface (121) at the opening of the receiving space (12). The protective cover (20) has a first surface (201) and a second surface (202), and the first surface (201) of the protective cover (20) is disposed in the receiving space (12) of the decoration cover (10), while the second surface (202) is disposed outside the decoration cover (10). A step portion (21) is circularly formed outside the attaching surface (121) of the decoration cover (10) corresponding to the protective cover (20), and the step portion (21) of the protective cover (20) is against the attaching surface (121) of the decoration cover (10) to increase the engaging strength of the decoration cover (10) and the protective cover (20). Also, the first surface (201) of the protective cover (20) has a connecting hole (22) having a protruding portion (221) that engages with the recessed portion (141) of the decoration cover (10), while the connecting hole (22) engages with the connecting post (14) of the cover (10). The cover (20) has a receiving trough (23) toward the direction of the cover block (11), one end of the flash drive (A) plugged into the receiving trough (23) and the other end plugged into the cover hole (13) of the cover block (11). When a user wants to use the flash drive (A), he/she only needs to bend the flexible decoration cover (10) to detach the protective cover (20) and the cover block (11), and the guiding surface (131) formed at the cover hole (13) is used to provide evading effect, so that the flash drive (A) can be taken out easily. Also, the cover block (11) and the protective cover (20) are easily pulled out from the decoration cover (10), so that the cover block (11), protective cover (20) and the decorative cover (10) are separated from each other, and the flash drive (A) can be retrieved quickly. According to the structure stated above, the protective cover (20) can achieve the goal of protecting the flash drive (A), and the decoration cover (10) can provide different styles/designs to increase the practicability.

Figure 5:
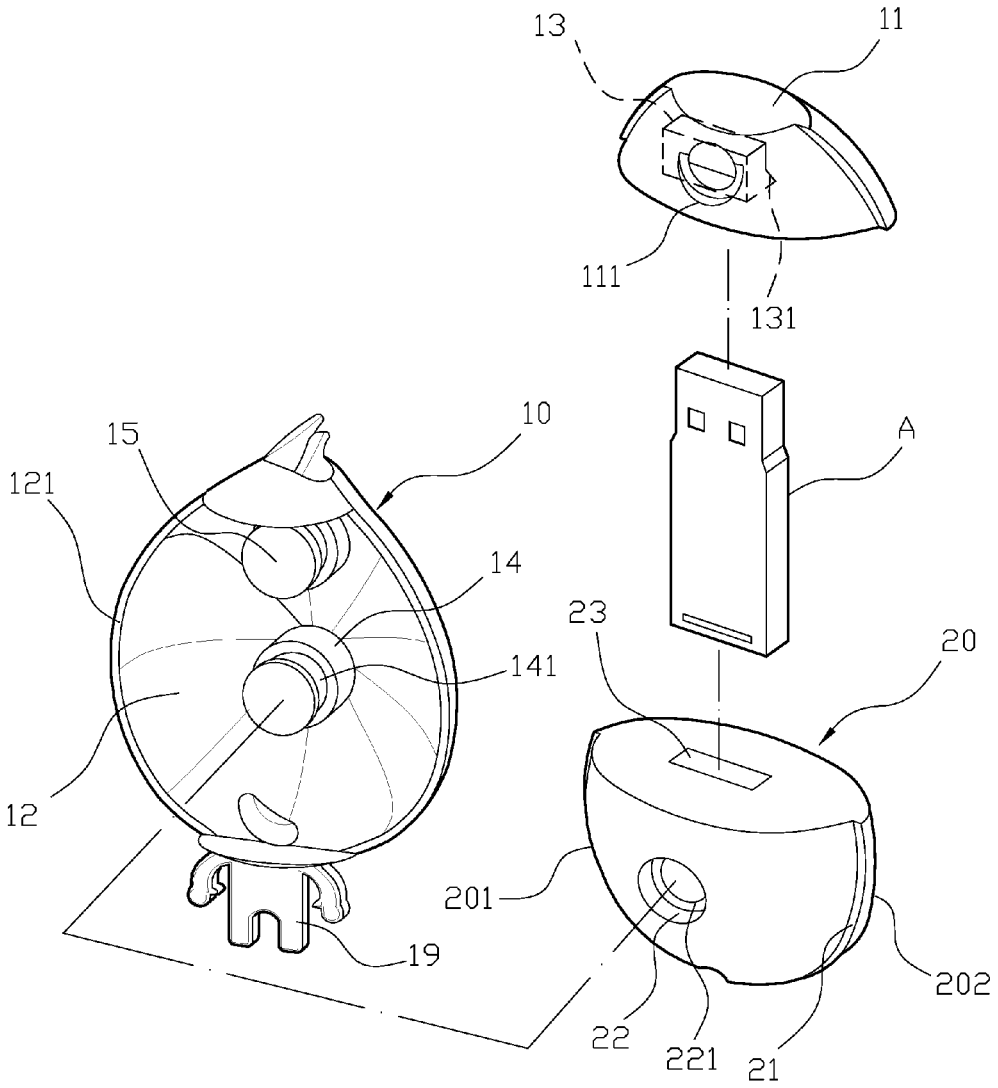
FIG. 5 illustrates a three-dimensional view of another embodiment in the present invention.
Figure 6:
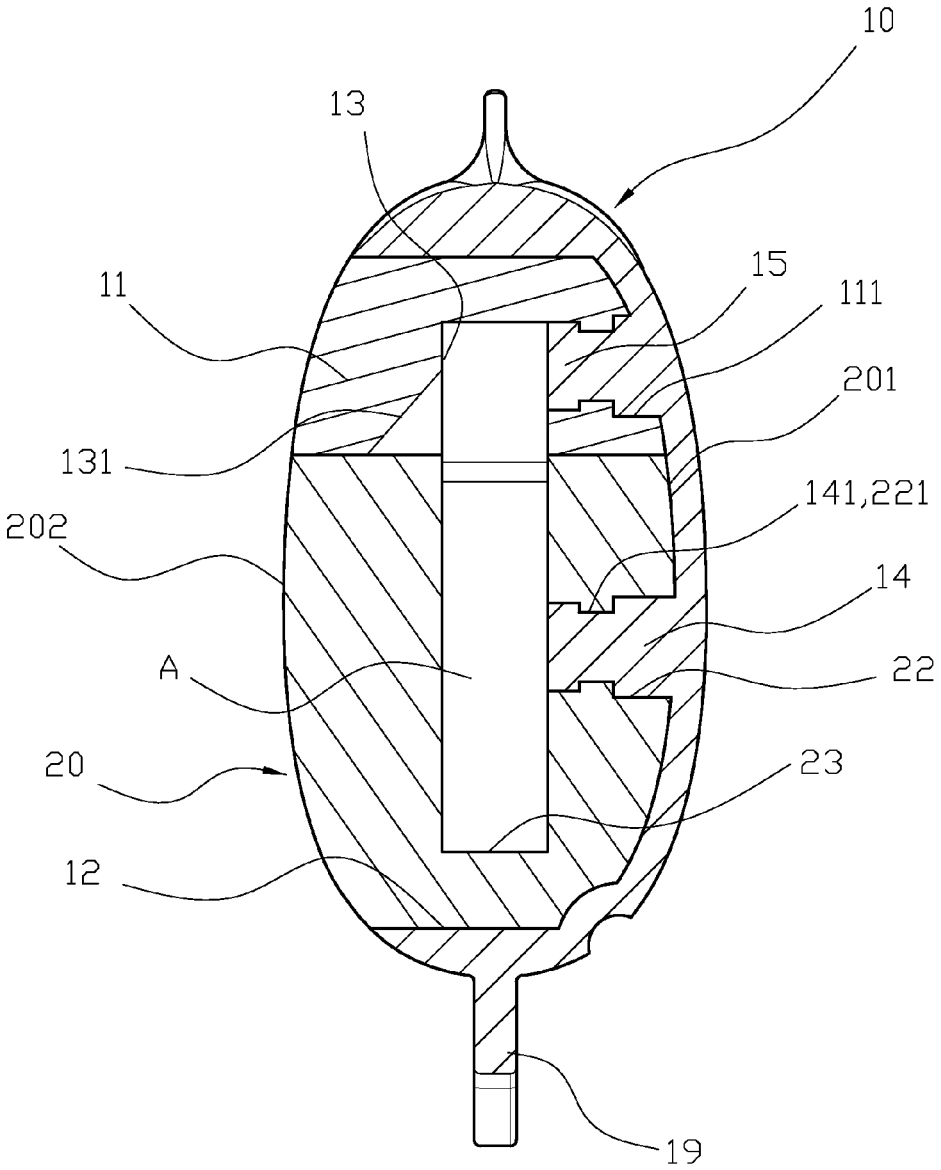
FIG. 6 illustrates a sectional view of another embodiment in the present invention.
Figure 7:
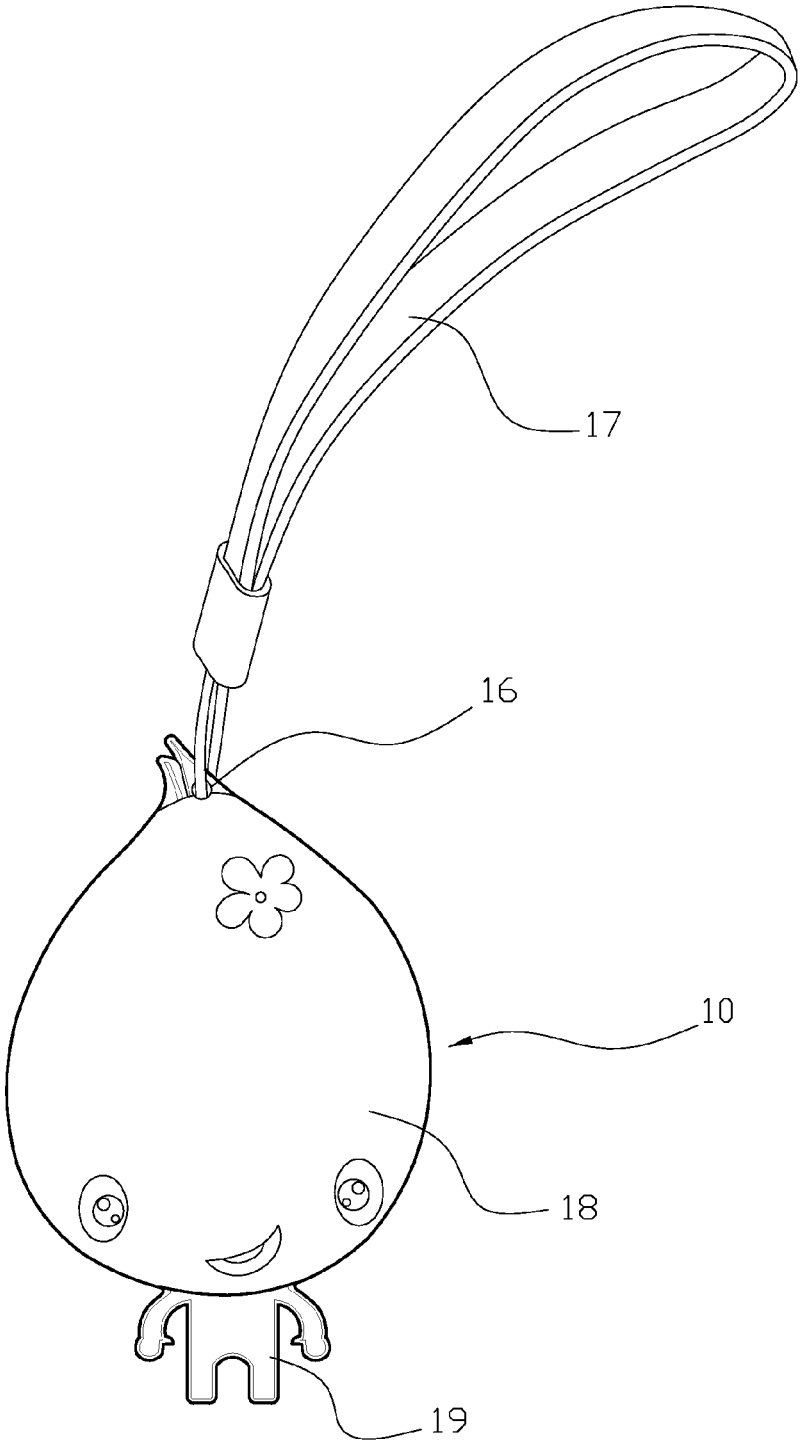
FIG. 7 illustrates a schematic view of the hanging decoration unit in the present invention.
Figure 8:
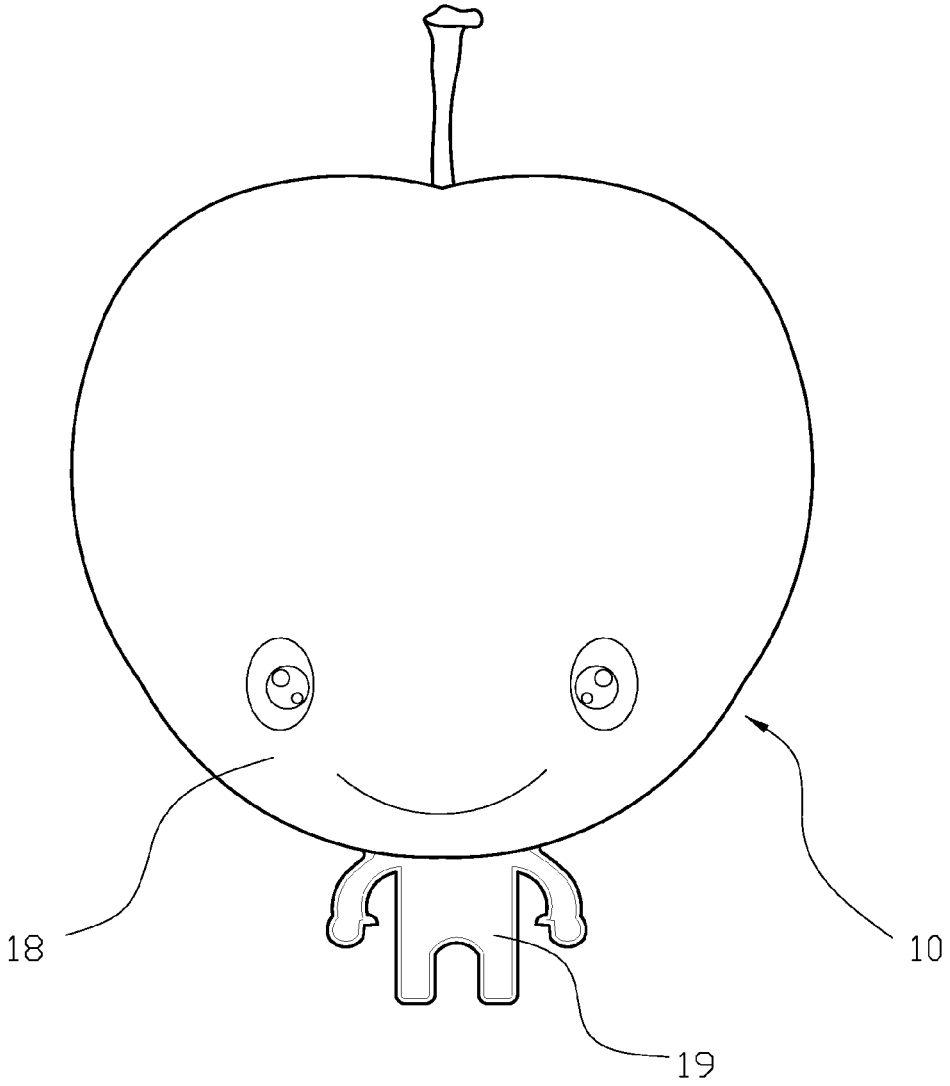
FIG. 8 illustrates a schematic view of different styles/designs of the decoration cover in the present invention.
Figure 9:
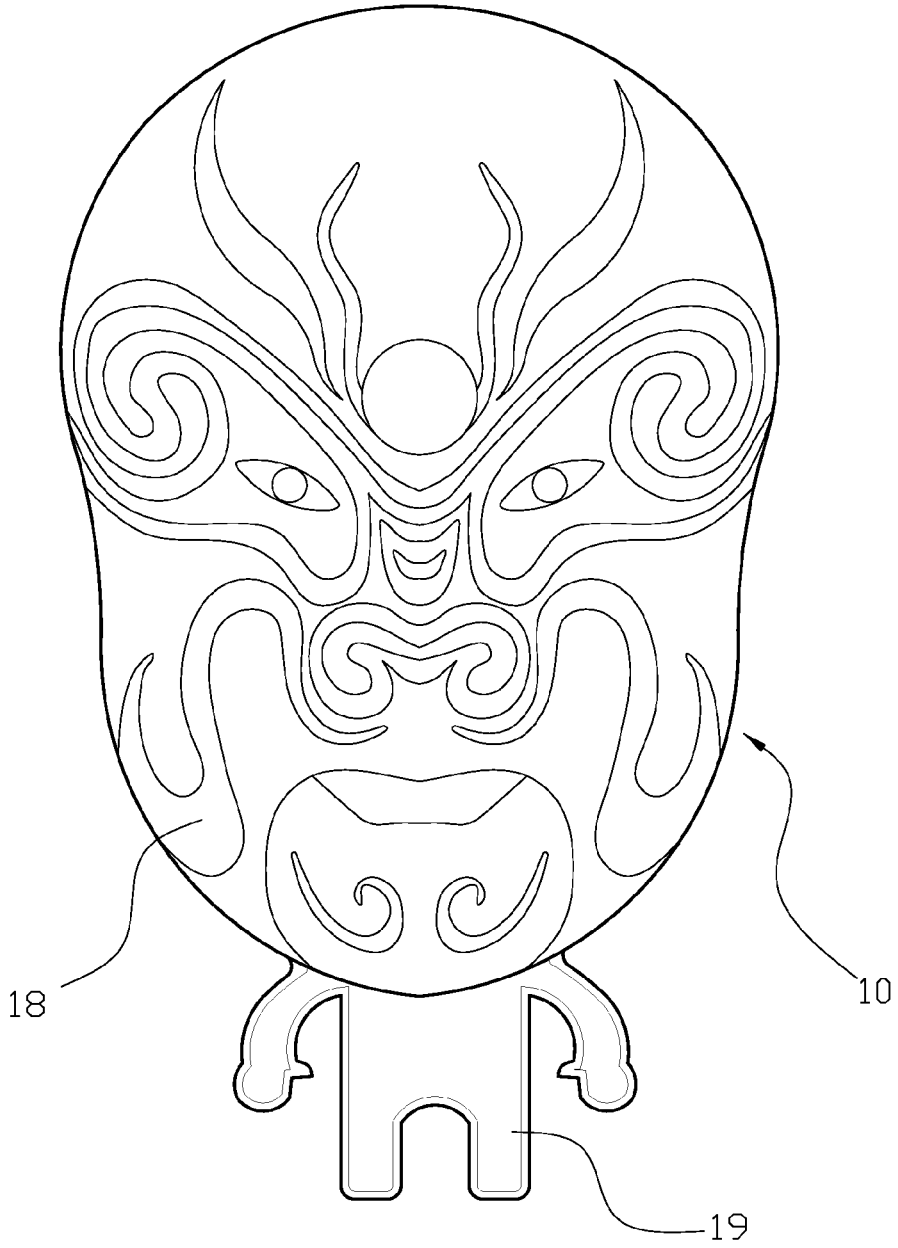
FIG. 9 illustrates a schematic view of a Chinese opera face on the decoration cover in the present invention.

In another embodiment shown in FIGS. 5 and 6, the flash drive protection cover includes a decoration cover (10) and a protective cover (20). The decoration cover (10) that is made by elastic materials includes a cover block (11) and a receiving space (12) spacedly. The cover block (11) is disposed separately at the decoration cover (10), and the cover block (11) has a fixed hole (111), and the decoration cover (10) has a fixed post (15) protrudingly formed corresponding to the cover block (11). The fixed hole (111) of the cover block (11) connects to the fixed post (15) of the decoration cover (10). Also, the cover block (11) has the cover hole (13) facing the receiving space (12), and the guiding surface (131) is formed at one end of the cover hole (13), and the connecting post (14) is formed inside the receiving space (12). The protective cover (20) is disposed in the receiving space (12) of the decoration cover (10), and includes a the connecting hole (22), so that the protective cover (20) can use the protruding portion (221) to engage the recessed portion (141) of the decoration cover (10). In other words, the connecting hole (22) connects with the connecting post (14) of the decoration cover (10). The cover (20) has a receiving trough (23) toward the direction of the cover block (11), one end of the flash drive (A) plugged into the receiving trough (23) and the other end plugged into the cover hole (13) of the cover block (11). When a user wants to use the flash drive (A), he/she only needs to bend the flexible decoration cover (10) to detach the protective cover (20) and the cover block (11), and the guiding surface (131) formed at the cover hole (13) is used to provide evading effect, so that the flash drive (A) can be taken out easily. As seen in FIG. 7, a through hole (16) is formed at the surface of the decoration cover (10), and a hanging decoration unit (17) can be disposed in the through hole (16). FIG. 8 shows that the outer surface of the decoration cover (10) has a facial portion (18), and the other end of the decoration cover (10) has a body portion (19). In other words, the decoration cover (10) can be designed to different appearances, not limited to the appearances disclosed in the present invention. For example, the facial portion (18) can be designed to a Chinese opera style as shown in FIG. 9, and the variety of decoration cover (10) can attract more people to purchase.

According to the embodiments discussed above, the present invention has following advantages: (a) the cover block (11) has the cover hole (13), and the protective cover (20) has the receiving trough (23) corresponding to the cover hole (13), so that the flash drive (A) can be placed between the cover block (11) and protective cover (20) through the disposition of the cover block (11) and the protective cover (20). This design can protect the flash drive (A) when it is not in use to avoid collision or abrasion, and to achieve the goal of waterproof; (b) the decoration cover (10) is used to wrap the cover block (11) and the protective cover (20) to provide different designs of the protective cover (20) to increase the value of the flash drive and attract more people to purchase; (c) the decoration cover (10) has the attaching surface (121), while the step portion (21) is at the outer surface of the protective cover (20), and since the engaging strength is increased through the attaching surface (121) and the step portion (21), the protective cover (20) and the decoration cover (10) would have a smooth contact surface; (d) the protective cover (20) is disposed in the receiving space (12) of the decoration cover (10), and the protective cover (20) partially exposes outside the decoration cover (10) through the second surface (202), so that the protective cover (20) can be easily detached from the decoration cover (10) to achieve the goal of quick retrieval to increase practicability; and (e) the cover block (11) forms the guiding surface (131) at the cover hole (13), and when the guiding surface (131) is bended to separate the cover block (11) and the protective cover (20), the flash drive (A) can evade through the guiding surface (131) so that the flash drive (A) can be easily taken out.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A flash drive protection structure comprising: a decoration cover made by elastic materials, including a cover block and a receiving space spacedly, wherein the cover block forms a cover hole facing the receiving space in a direction, a guiding surface is formed at one end of the cover hole, and a connecting post is formed inside the receiving space; and a protective cover having a first surface and a second surface, said protective cover disposed in the receiving space of the decoration cover through the first surface, while the second surface exposed outside the decoration cover, wherein the protective cover has a connecting hole at the first surface to connect the connecting post of the decoration cover, and the protective cover has a receiving trough toward an opposite direction of the cover hole before the flash drive is evaded from the guiding surface, and one end of a flash drive is plugged into the receiving trough, while the other end of the flash drive is plugged into the cover hole of the cover block; and the cover block includes a fixed hole connecting with a fixed post protrudingly formed on the decoration cover.

2. The flash drive protection structure of claim 1, wherein the cover block is separately disposed at the decoration cover.

3. The flash drive protection structure of claim 1, wherein the decoration cover forms an attaching surface at an opening of the receiving space, and a step portion is circularly formed outside the attaching surface of the decoration cover corresponding to the protective cover, and a step portion of the protective cover is against the attaching surface of the decoration cover.

4. The flash drive protection structure of claim 1, wherein the decoration cover has a recessed portion at the connecting post, and the protective cover has a protruding portion at the connecting hole, and the protruding portion of the protective cover engages with the recessed portion of the decoration cover.

5. The flash drive protection structure of claim 1, wherein a wall surface of the receiving space of the decoration cover is of an arc shape.

6. The flash drive protection structure of claim 1, wherein a through hole is formed at a surface of the decoration cover, and a hanging decoration unit is allowed to pass through the through hole.

7. The flash drive protection structure of claim 1, wherein a facial portion is formed at an outer surface of the decoration cover, while a body portion is formed at one end extended from the decoration cover.

8. The flash drive protection structure of claim 7, wherein the facial portion is of a Chinese opera style.

* * * * *